US007409936B2

(12) United States Patent
Machida

(10) Patent No.: US 7,409,936 B2
(45) Date of Patent: Aug. 12, 2008

(54) CAM ANGLE DETECTING APPARATUS, AND CAM PHASE DETECTING APPARATUS FOR INTERNAL COMBUSTION ENGINE AND CAM PHASE DETECTING METHOD THEREOF

(75) Inventor: Kenichi Machida, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 8 days.

(21) Appl. No.: 11/374,156

(22) Filed: Mar. 14, 2006

(65) Prior Publication Data

US 2006/0207534 A1 Sep. 21, 2006

(30) Foreign Application Priority Data

Mar. 17, 2005 (JP) ..... 2005-076245

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 5,245,968 | A | 9/1993 | Kolias et al. | |
| 5,469,735 | A * | 11/1995 | Watanabe | 73/118.1 |
| 6,135,078 | A * | 10/2000 | Doi et al. | 123/90.18 |
| 2003/0192495 | A1 * | 10/2003 | Hagner et al. | 123/90.17 |
| 2006/0201238 | A1 * | 9/2006 | Trapasso et al. | 73/117.3 |

FOREIGN PATENT DOCUMENTS

| | | |
|---|---|---|
| JP | 2000-303865 | 10/2000 |

* cited by examiner

*Primary Examiner*—Zelalem Eshete
(74) *Attorney, Agent, or Firm*—Foley & Lardner LLP

(57) ABSTRACT

An in-line four-cylinder engine provided with a variable valve timing mechanism which changes a rotation phase of a camshaft relative to a crankshaft, and a cam angle sensor which outputs a cam angle signal at each 45 (deg.) of the camshaft, detection of an angle spanning from a reference rotational position of the crankshaft to the cam angle signal being made to thereby detect the rotation phase of the camshaft.

12 Claims, 7 Drawing Sheets

CAM ANGLE DETECTING APPARATUS, AND CAM PHASE DETECTING APPARATUS FOR INTERNAL COMBUSTION ENGINE AND CAM PHASE DETECTING METHOD THEREOF

BACKGROUND OF THE INVENTION

1. Field of the Invention

The present invention relates generally to a variable valve timing mechanism for an internal combustion engine, which changes a rotation phase of a camshaft relative to a crankshaft so as to vary valve timing of an engine valve, and more particularly to a novel technology for detecting the rotation phase of the camshaft.

2. Description of the Related Art

Japanese Unexamined Patent Publication No. 2000-303865 discloses a method of detecting a rotation phase of a camshaft relative to a crankshaft in an in-line four-cylinder internal combustion engine provided with a variable valve timing mechanism.

In the above detecting method, there are provided: a crank angle sensor which generates a crank angle signal at each angle equivalent to a stroke phase difference between cylinders; and a cam angle sensor which generates a cam angle signal at an angular interval the same as that of the crank angle sensor, so that a difference in phase of both signals, i.e., a phase difference of the cam angle signal from that of the crank angle signal is measured.

In a region where an engine rotating speed is low, such as, at the starting of an engine operation, at an idling time or the like, it is required to achieve an improvement in the operating performance of the engine by varying valve timing.

However, in the conventional apparatus, since the detecting cycle of the valve timing is set at each difference in the stroke phase between cylinders, a time interval in which the detecting result of the valve timing is updated becomes long in the low rotating speed region.

Therefore, conventionally, in a feedback control of the variable valve timing mechanism, the overshooting might occur in the low rotating speed region.

SUMMARY OF THE INVENTION

In view of the above problem, the present invention has an object to suppress that a time interval in which a detection value of valve timing is updated becomes excessively long in a low rotating speed region.

In order to achieve the above object, the present invention provides a cam angle detecting apparatus in which there is disposed a rotation member rotated in association with or integrally with a camshaft, the rotation member being provided with equiangularly arranged detectable portions for being detected, the number of which is the integer n ($n \geqq 2$) times of the number of cylinders having an engine valve driven by the camshaft, respectively, and in which a sensor is disposed to detect the detectable portions to issue an output indicative of cam angle signal.

Further, in accordance with the present invention, there are provided apparatus and method for detecting a cam phase for an internal combustion engine, in which a rotation member is disposed to be rotated in association with or integrally with a camshaft, the rotation member being provided with equiangularly arranged detectable portions for being detected, the number of which is the integer n ($n \geqq 2$) times of the number of cylinders having an engine valve driven by the camshaft, respectively, and in which a sensor is disposed to detect the detectable portions to issue an output indicating a cam angle signal, and also, a rotational position of a crankshaft is detected, to issue an output indicating a reference angle signal at every crank angle equivalent to a difference in a stroke-phase between cylinders of the internal combustion engine, thereby measuring a difference in phase between the cam angle signal and the reference angle signal.

The other objects and features of this invention will become understood from the following description with reference to the accompanying drawings.

PREFERRED EMBODIMENTS

Figure 1:
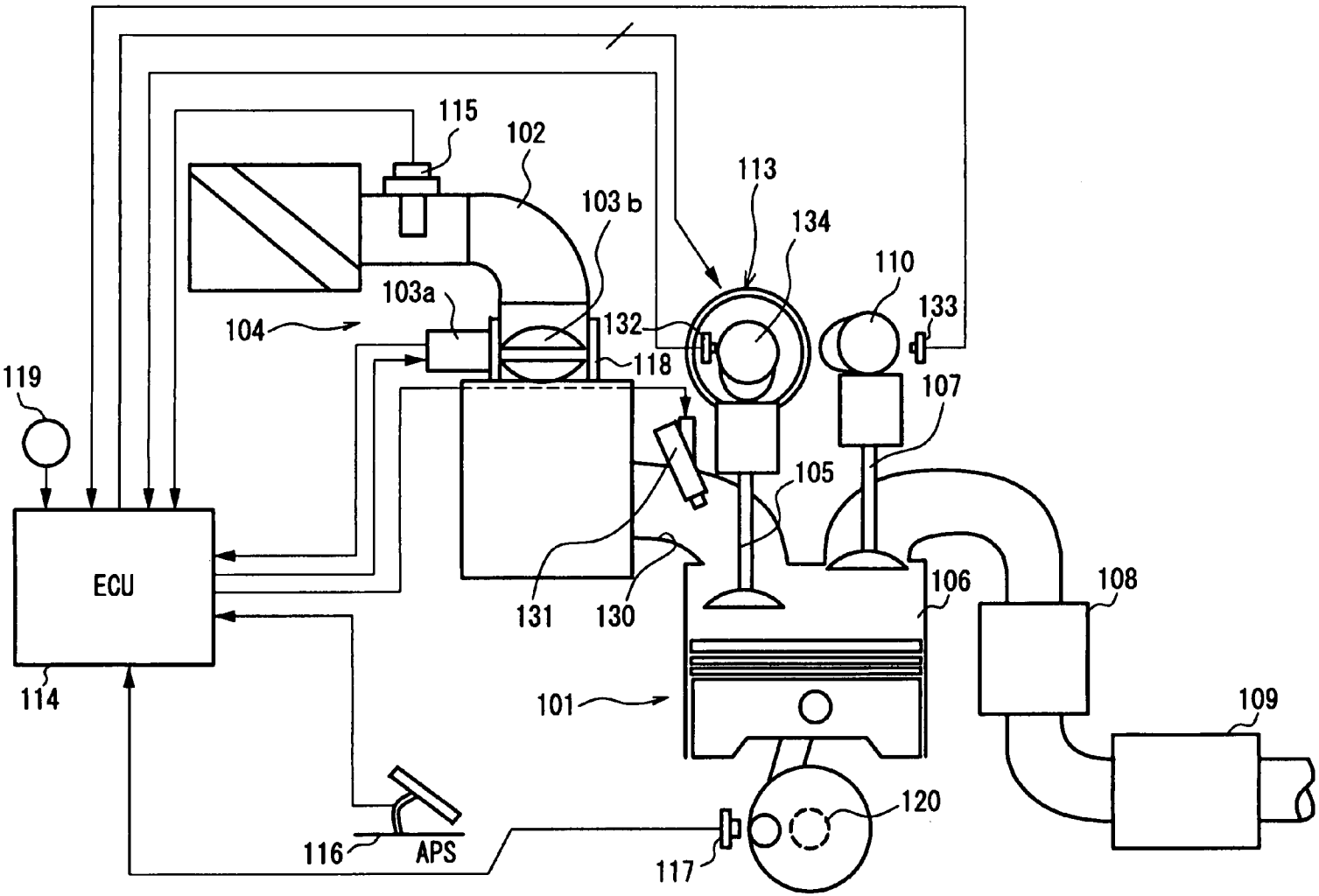
FIG. 1 is a systematic diagram of an internal combustion engine in an embodiment of the invention.

FIG. 1 is a block diagram illustrating an in-line four-cylinder gasoline engine in an embodiment of the present invention.

In FIG. 1, an internal combustion engine 101 has an intake pipe 102 in which an electronically controlled throttle 104 is provided for driving the opening or closing of a throttle valve 103*b* by the use of a throttle motor 103*a*.

Then, air is sucked into a combustion chamber 106 via electronically controlled throttle 104 and an intake valve 105.

A fuel injection valve 131 is disposed at an intake port 130 of each cylinder. Fuel injection valve 131 is opened based on an injection pulse signal from an engine control unit (ECU) 114, to inject fuel toward intake valve 105.

The fuel together with the air introduced, by suction, into combustion chamber 106 is ignited by a spark ignition by an ignition plug (not shown), to make combustion therein.

The burnt gas in combustion chamber 106 is discharged into an exhaust pipe via an exhaust valve 107, and is purified by a front catalytic converter 108 and a rear catalytic converter 109, and thereafter, is emitted into the atmosphere.

Intake valve 105 and exhaust valve 107 are opened or closed respectively by cams disposed on an intake camshaft 134 and an exhaust camshaft 110.

Further, four strokes of intake, compression, explosion and exhaust, are executed by each of cylinders with a time shift corresponding to each 180 (deg.) of crank angle between cylinders.

Exhaust camshaft 110 and intake camshaft 134 are driven by a crankshaft 120 via a timing chain or a timing belt, to perform one rotation per two rotations of crankshaft 120.

A variable valve timing mechanism 113 is provided on intake camshaft 134.

Variable valve timing mechanism 113 is a mechanism which changes a rotational phase of intake camshaft 134 relative to crankshaft 120, to vary valve timing of intake valve 105.

Figure 2:
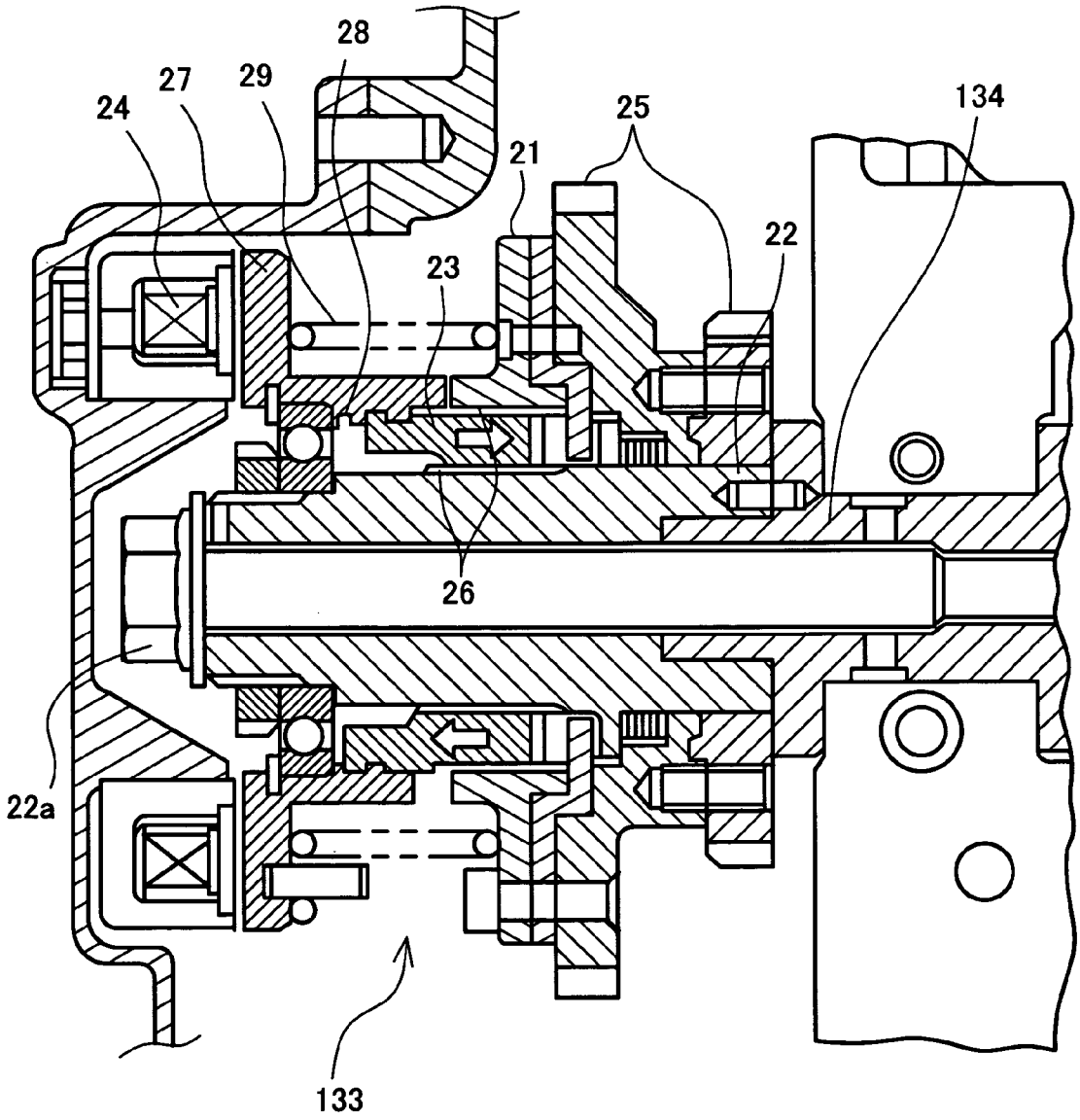
FIG. 2 is a cross section showing a variable valve timing mechanism in the embodiment of the invention.

FIG. 2 illustrates a structure of variable valve timing mechanism 113.

Variable valve timing mechanism 113 includes: a first rotator 21 which is fixed to a sprocket 25 rotated in synchronism with crankshaft 120 (FIG. 1), to be rotated in association with or integrally with sprocket 25; a second rotator 22 which is fixed to one end of intake camshaft 134 by means of a bolt 22*a*, to be rotated in association with or integrally with intake camshaft 134; and a cylindrical intermediate gear 23 which is engaged with an inner peripheral face of first rotator 21 and an outer peripheral face of second rotator 22 by means of helical splines 26.

A drum 27 is connected to intermediate gear 23 via a triple thread screw 28, and a torsion spring 29 is disposed between drum 27 and intermediate gear 23.

Intermediate gear 23 is urged toward a retarded angle direction (left direction in FIG. 2) by torsion spring 29, and when a voltage is applied to an electromagnetic retarder 24 to generate a magnetic force, intermediate gear 23 is moved to an advanced angle direction, via drum 27 and triple thread screw 28.

A relative phase between rotators 21 and 22 is changed according to a position of intermediate gear 23 in a shaft direction, so that a phase of intake camshaft 134 relative to crankshaft 120 is changed.

An electric actuator 17 and electromagnetic retarder 24 are controlled according to engine operating conditions, based on control signals from engine control unit 114.

Incidentally, the variable valve timing mechanism is not limited to the structure employing en electromotive type as shown in FIG. 2, and it is possible to use another type of mechanism such as a hydraulically driven type mechanism, provided that the rotation phase of the camshaft relative to the crankshaft is changed so that the valve timing of the engine valve is varied.

Engine control unit 114 incorporating therein a microcomputer, performs the computing process of detection signals from various sensors in accordance with a preliminarily stored program, to output control signals for electronically controlled throttle 104, variable valve timing mechanism 113 and fuel injection valve 131.

As the various sensors, there are arranged: an accelerator opening sensor 116 for detecting an accelerator opening; an air flow meter 115 for detecting an intake air amount Q of engine 101; a crank angle sensor 117 for detecting a rotation angle of crankshaft 120; a throttle sensor 118 for detecting an opening TVO of throttle valve 103*b*; a water temperature sensor 119 for detecting the cooling water temperature of engine 101; a cam angle sensor 132 for detecting a rotation phase of intake camshaft 134 whose phase is made variable by variable valve timing mechanism 113; and a cylinder discriminating sensor 133 which is provided for exhaust camshaft 110, for discriminating a cylinder which takes a reference piston position.

Figure 4:
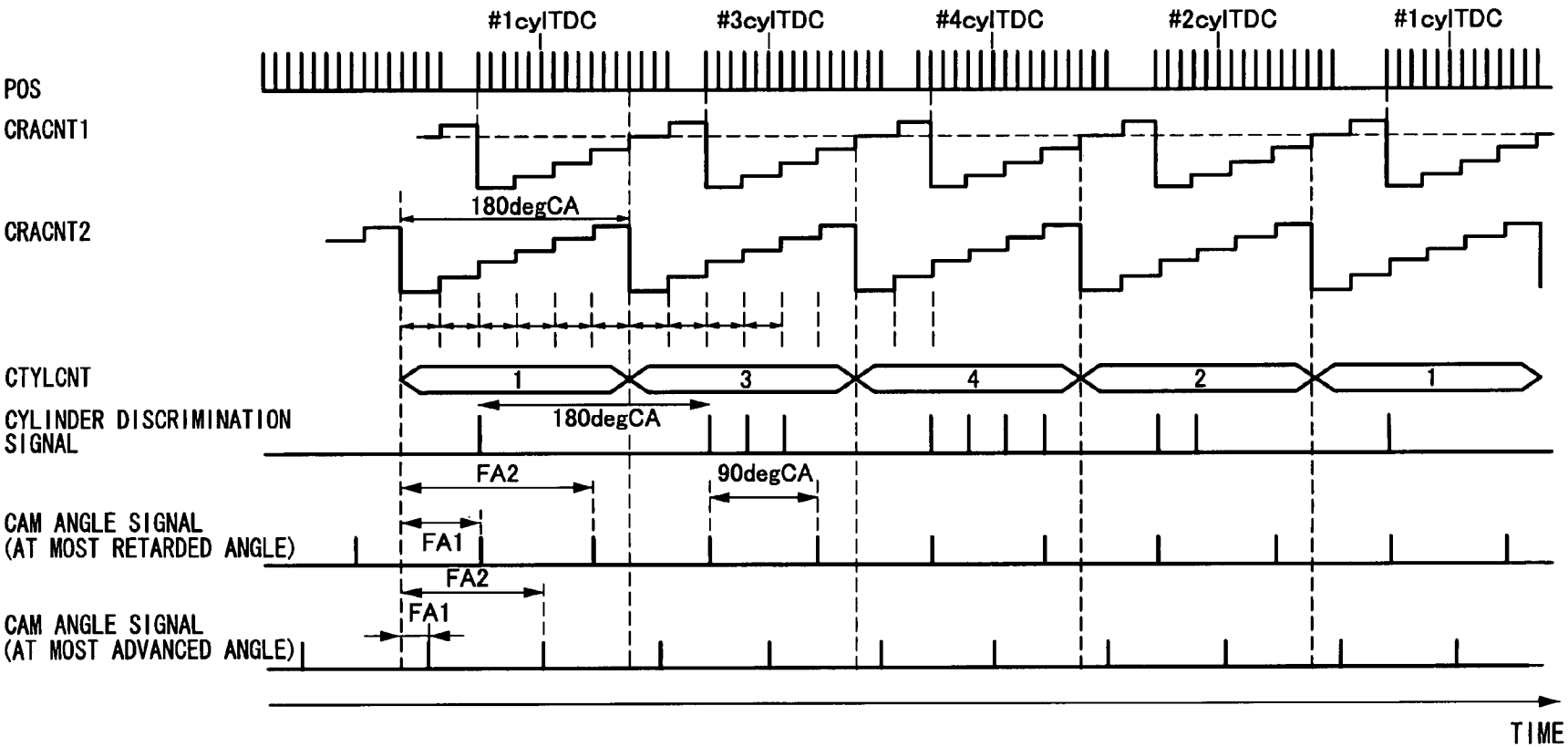
FIG. 4 is a time chart showing output timing of detection signals from respective sensors in the first embodiment.

Crank angle sensor 117 includes: a signal plate 117*a* coaxially supported on crankshaft 120; detectable portions for being detected 117*b* disposed on signal plate 117*a*; and a sensor element 117*c* for detecting detectable portions 117*b*. Then, as shown in FIG. 4, crank angle sensor 117 outputs a series of unit crank angle signals POS each of which rises at each crank angle of 10 (deg.) with the top dead center of each cylinder as a starting point.

Here, the unit crank angle signals POS are set, so that signals disappear at the specific rotational positions of 60 (deg.) and 70 (deg.) before the top dead center of each cylinder. In other words, two consecutive unit crank angle signals POS do not output at every crank angles of 180 (deg.) which correspond to a stroke phase difference between cylinders in engine 101.

Incidentally, it is possible to use a crank angle sensor which may individually output the unit crank angle signals POS without any disappearance of signals and reference crank angle signals for every stroke phase differences.

Figure 3:
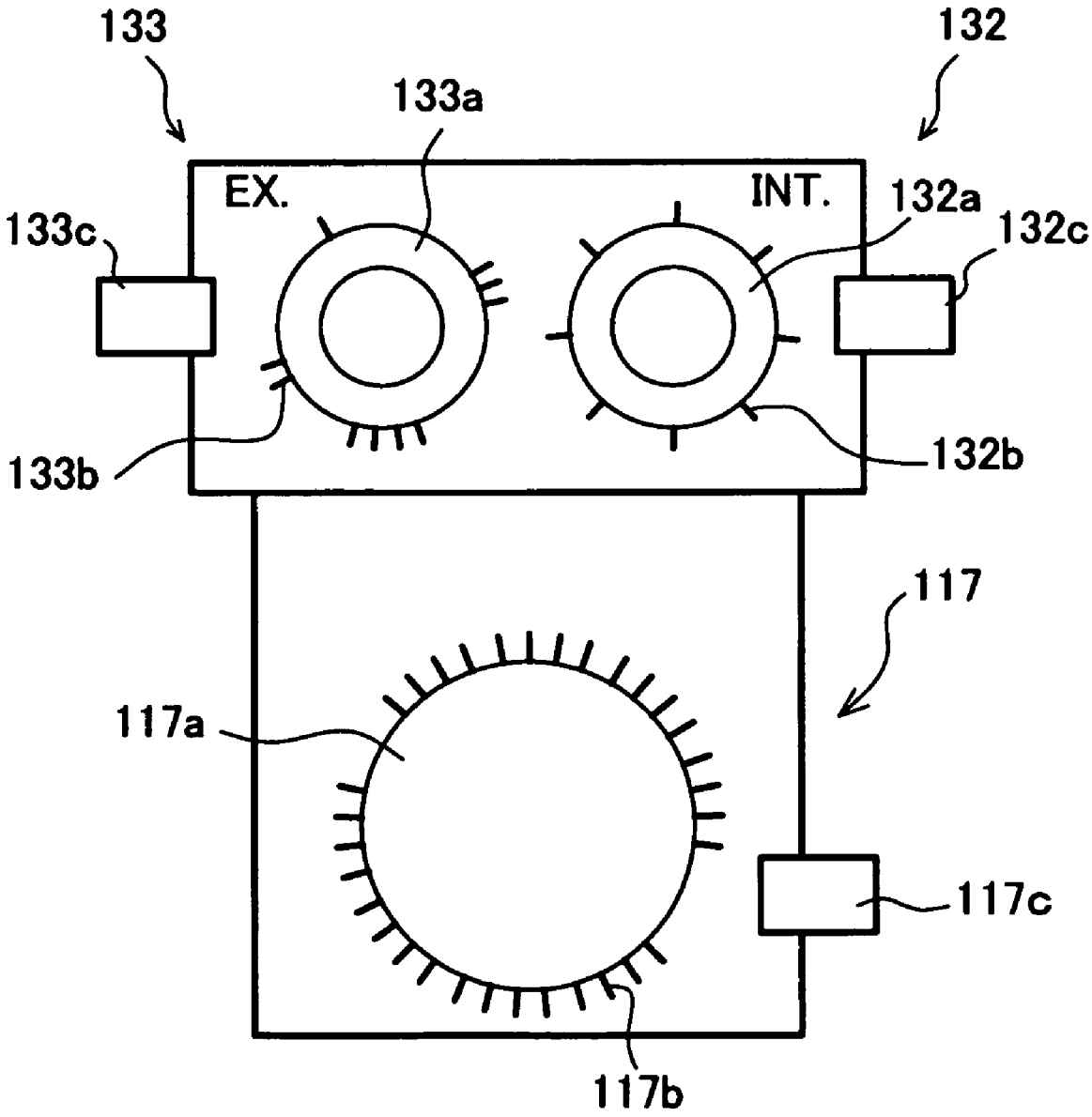
FIG. 3 is a pattern diagram showing configurations of a cam angle sensor, a cylinder discriminating sensor and a crank angle sensor in a first embodiment of the invention.

Further, as shown in FIG. 3, cylinder discriminating sensor 133 includes: a signal plate 133*a* coaxially supported on exhaust camshaft 110; detectable portions 133*b* for being detected that are disposed on signal plate 133*a* at positions spaced apart each 90 (deg.) interval in a manner such that the number of detectable portions of respective positions are mutually different from one another; and a sensor element 133*c* for detecting detectable portions 133*b*. Then, as shown in FIG. 4, cylinder discriminating sensor 133 outputs a cylinder discrimination signal indicating, by impulses, the cylinder number of cylinder which is on the reference piston position, at every crank angles of 180 (deg.) which correspond to the stroke phase difference between cylinders.

Moreover, as shown in FIG. 3, cam angle sensor 132 includes: a signal plate 132*a* coaxially supported on intake camshaft 134; eight detectable portions 132*b* for being detected that are disposed on signal plate 132*a* at equiangular intervals of each 45 (deg.); and a sensor element 132*c* for detecting detectable portions 132*b*. Then, as shown in FIG. 4, cam angle sensor 132 outputs cam angle signals to be used for detecting the phase of intake camshaft 134, at each crank angle of 90 (deg.).

Note, respective detectable portions 117*b*, 133*b* and 132*b* for being detected may be directly formed on the above-mentioned respective shafts.

Further, the ignition in the present embodiment is performed in order of #1 cylinder→#3 cylinder→#4 cylinder→#2 cylinder.

Engine control unit 114 detects the unit crank angle signal POS that is output at a position of 50 (deg.) before the top dead center, based on a change in the cycle of the unit crank angle signal POS. Then, engine control unit 114 clears a value of a counter CRACNT1, which is counted up each time when three of unit crank angle signals POS are input, at a position of 50 (deg.) before the top dead center.

Further, engine control unit 114 clears a value of a counter CRACNT2, which is counted up each time when three of unit crank angle signals POS are input, at each time when the value of counter CRACNT1 reaches "4".

Then, engine control unit 114 counts frequency of generation of the cylinder discrimination signals during a time period from clearing of counter CRACNT2 to a subsequent clearing thereof, and discriminates the cylinder which comes next to the compression top dead center, based on the counter data, to update a cylinder discrimination value CTYLCNT based on the discrimination result.

For example, when three of the cylinder discrimination signals are output during the time period from clearing of counter CRACNT2 to a subsequent clearing thereof, it is judged that the cylinder which comes next to the compression top dead center is #4 cylinder, and the cylinder discrimination value CTYLCNT is switched from "3" to "4" at timing when counter CRACNT2 is cleared.

Engine control unit 114 specifies the cylinder on which the fuel injection or the ignition is performed, based on, the cylinder discrimination value CTYLCNT.

Further, engine control unit 114 detects phase angles FA1 and FA2 until two of the cam angle signals are output after the timing of clearing of counter CRACNT2, by the counting of the unit crank angle signals POS and by the time measurement.

Then, engine control unit 114 obtains an actual rotation phase of intake camshaft 134 based on the newest detected phase angle FA, to feedback control variable valve timing mechanism 113 so that the actual rotation phase approaches a target rotation phase.

According to the above embodiment, since the cam angle signal is output at every crank angle of 90 (deg.), the detection value of the rotation phase is updated at every crank angle of 90 (deg.) which is the half of the stroke phase difference between adjacent cylinders. Accordingly, it is possible to prevent that an update cycle of the rotation phase is lengthened at the low rotational speed region such as the idle operation time, resulting in the degradation of the rotation phase control accuracy.

Incidentally, in the above embodiment, eight detectable portions 132*b* for being detected are disposed at equiangular intervals on signal plate 132*a* of cam angle sensor 132. However, detectable portions 132*b* may be disposed at even intervals by the numbers which are the integer n times (n≧2) the number of cylinders (=4). For example, if twelve or sixteen detectable portions for being detected are disposed at even intervals, the update cycle can be further shortened.

Next, there will be described a second embodiment in which the present invention is applied to a V-type six-cylinder engine.

Figure 5:
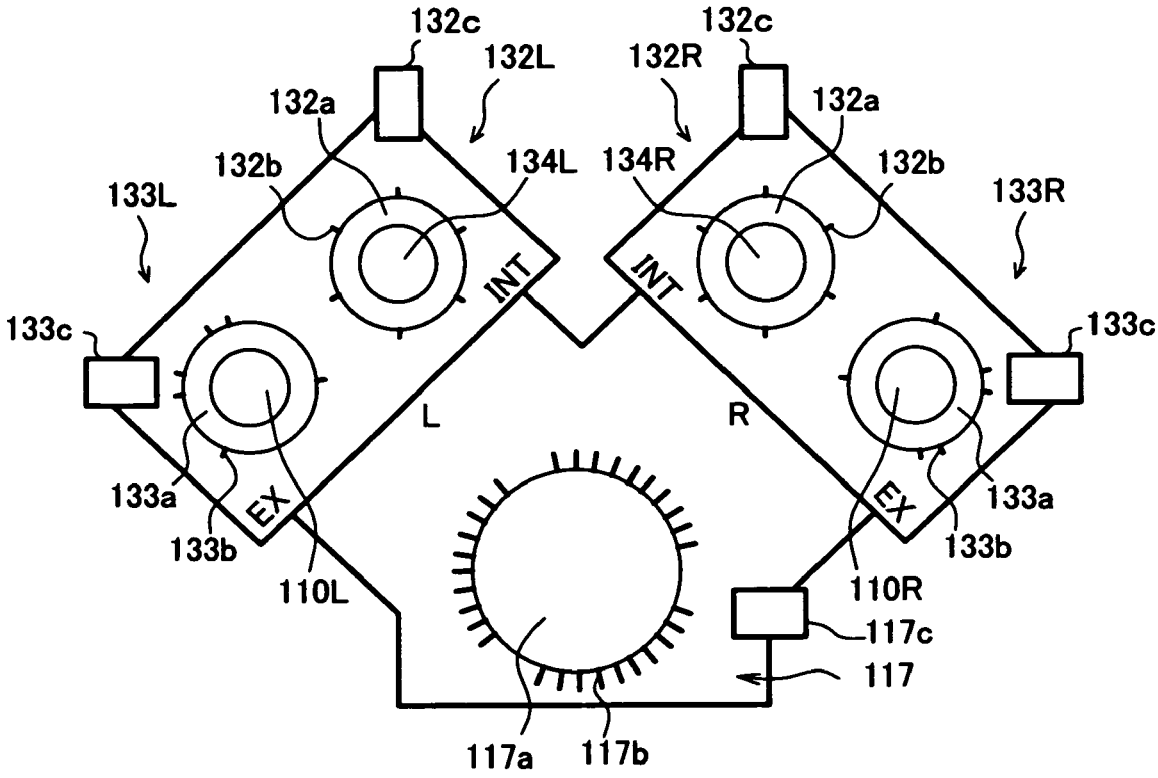
FIG. 5 is a pattern diagram showing configurations of a cam angle sensor, a cylinder discriminating sensor and a crank angle sensor in a second embodiment of the invention.

FIG. 5 shows configurations of cam angle sensor 132, cylinder discriminating sensor 133 and crank angle sensor 117 in the second embodiment.

The V-type six-cylinder engine shown in FIG. 5 includes three cylinders on each of right and left banks. An exhaust camshaft 110L and an intake camshaft 134L are provided on a left bank L, while an exhaust camshaft 110R and an intake camshaft 134R are provided on a right bank R.

Variable valve timing mechanism 113 is provided for each of intake camshaft 134L and intake camshaft 134R, and also, cam angle sensors 132L and 132R are disposed for intake camshaft 134L and intake camshaft 134R, respectively.

Exhaust cum shafts 110L and 110R are arranged to rotate with a prescribed angular phase relative to crankshaft 120, and are provided with cylinder discriminating sensors 133L and 133R, respectively.

Crank angle sensor 117 outputs the unit crank angle signals POS in the form of pulse signals which rise at every crank angle of 10 (deg.). However, the unit crank angle signals POS are set so as not to be output at the rotational positions of 60 (deg.) and 70 (deg.) before the top dead center of each cylinder (refer to FIG. 6 and FIG. 7).

In the six-cylinder engine in the present embodiment, since the stroke phase difference between adjacent cylinders is set at crank angle of 120 (deg.), two consecutive unit crank angle signals POS disappear at each crank angle of 120 (deg.).

Figure 6:
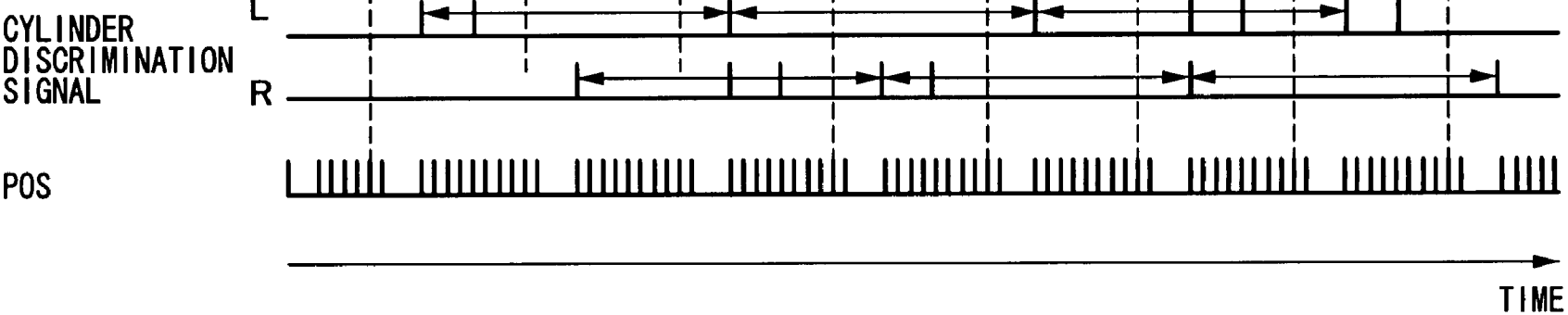
FIG. 6 is a time chart showing output timing of a cylinder discriminating signal in the second embodiment.

Each of cylinder discriminating sensors 133L and 133R outputs the cylinder discrimination signal at each camshaft rotation angle of 120 (deg.) so that the cylinder discrimination can be performed at each crank angle of 240 (deg.) which corresponds to the stroke phase difference among the three cylinders included in each bank (refer to FIG. 6).

To be specific, each of cylinder discriminating sensors 133L and 133R generates the pulse signals in order of one pulse signal→one pulse signal→two pulse signals, at each camshaft rotation angle of 120 (deg.). Here, detectable portions 133*b* for being detected are set, so that two additional pulse signals generate during an intermediate period of time between the timing when one pulse signal generates and the timing when two pulse signals generate 120 (deg.) late after the timing of generation of one pulse signal.

Further, cylinder discriminating sensor 133L and cylinder discriminating sensor 133R are set, so that phases of pulse generation cycle at each 120 (deg.) thereof are deviated from each other by a half cycle.

Hence, since one of every one pulse signals that output at each 120 (deg.) is synchronized with the two additional pulse signals that output from the other cylinder discriminating sensor 133, and by judging this synchronization, it is possible to discriminate every one pulse signals that appear and output at each 120 (deg.) intervals.

Figure 7:
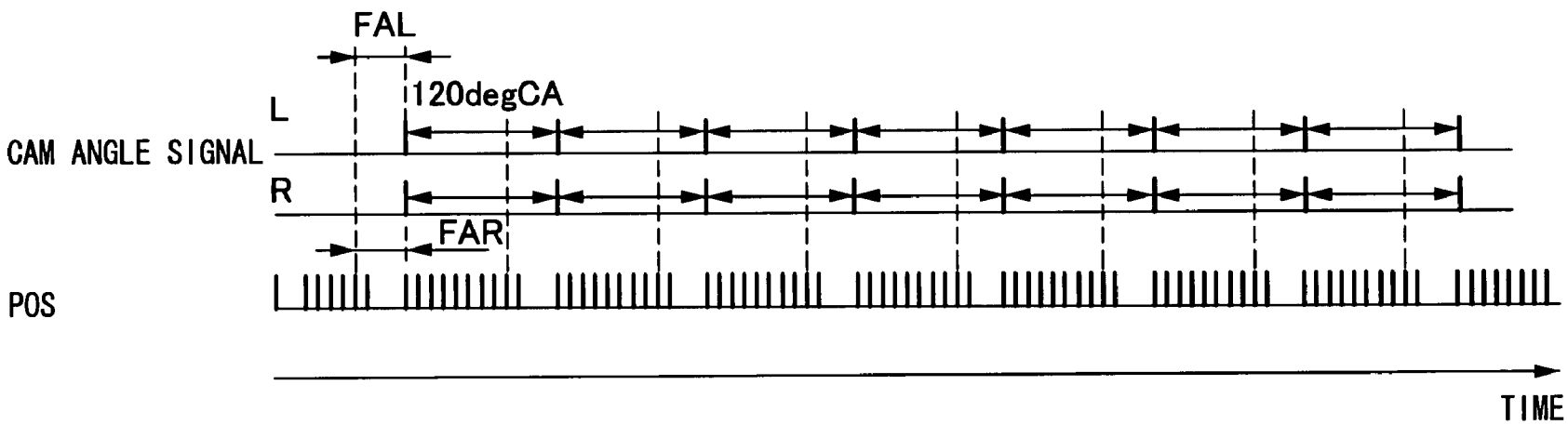
FIG. 7 is a time chart showing output timing of a cam phase signal in the second embodiment.

Moreover, each of cam angle sensors 132L and 132R is disposed with six detectable portions 132*b* for being detected at equivalent intervals of each 60 (deg.) of camshaft, which correspond to crank angle 120 (deg.), and detects six detectable portions 132*b* to output the cam angle signal (refer to FIG. 7).

Then, each of angles FAL and FAR from the reference crank angle position at each crank angle of 120 (deg.), which is detected based on the position where the unit crank angle signal POS is not output, to the cam angle signal output from each of cam angle sensors 132L and 132R at each crank angle of 120 (deg.), is measured in each bank, so that the rotation phase of intake camshaft in each bank is detected at each crank angle of 120 (deg.).

Consequently, it is possible to prevent that the update cycle of the detection value of the rotation phase is excessively lengthened at the low rotating speed region such as the idle operation time, resulting in the significant degradation of the rotation phase control accuracy.

Incidentally, in the above embodiment, the configuration is such that, in the V-type six-cylinder engine, the six detectable portions for being detected are disposed at even intervals at each 60 (deg.) of camshaft, to output the cam angle signal at each 60 (deg.) of camshaft. However, the configuration may be such that the detectable portions are disposed at even intervals by the numbers which are the integer n times (n≧2) the number of cylinders (=3), and for example, nine or twelve detectable portions for being detected may be disposed at even intervals.

Further, in a case of an in-line six-cylinder engine, twelve detectable portions for being detected are disposed on a signal plate of a camshaft at even intervals, and a detection signal of each detectable portion for being detected is output as a cam angle signal, so that a detection value of a rotation phase can be updated at each 60 (deg.) which is the half of 120 (deg.) equivalent to a stroke phase difference between cylinders.

Namely, the internal combustion engine to which the present invention is applied is not limited to the in-line four-cylinder engine or the V-type six-cylinder engine.

The entire contents of Japanese Patent Application No. 2005-076245 filed on Mar. 17, 2005, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined by the appended claims and their equivalents.

I claim:

1. A cam phase detecting apparatus for an internal combustion engine provided with a variable valve timing mechanism which changes a rotation phase of a camshaft relative to a crankshaft to vary valve timing of an engine valve, comprising:

a cam angle detector that outputs a cam angle signal indicating a rotational position of said camshaft;

a crank angle detector that detects a rotational position of said crankshaft to output a reference angle signal at each crank angle corresponding to a stroke phase difference between cylinders of said internal combustion engine;

a measuring section that measures a phase difference between said cam angle signal and said reference angle; and a rotation phase detector that detects the rotation phase of said camshaft based on the phase difference measured by said measuring section, wherein:

said cam angle detector is configured to arrange detectable portions for being detected on a rotation member that is capable of being rotated in association with said camshaft, said detectable portions being disposed at equiangular intervals, by numbers which are an integer n ($n \geqq 2$) times a number of cylinders, each having the engine valve driven by said camshaft, said detectable portions being detected by a sensor to thereby output said cam angle signal, so that said cam angle signals, the number of which are the integer n ($n \geqq 2$), are output in each generating interval of said reference angle signals, said measuring section measures a phase difference between a generation timing of said reference angle signal and each generation timing of subsequently outputted cam angle signals, the number of which are the integer n ($n \geqq 2$ ), and said rotation phase detector detects the rotation phase several times in each generation interval of said reference angle signals, by detecting the rotation phase of said camshaft at every time said cam angle signal is generated, based on the phase difference of each output of said cam angle signals measured by said measuring section.

2. The apparatus according to claim 1, wherein an output position indicated by said cam angle signal changes within an angular range defined between each of said reference angle signal.

3. The apparatus according to claim 1, wherein said detectable portions are disposed on said rotation member at equiangular intervals by the numbers which are the integer 2 times the number of cylinders, each having the engine valve driven by said camshaft.

4. The apparatus according to claim 1, further comprising a control section that computes a feedback control signal for said variable valve timing mechanism based on the rotation phase of said camshaft detected by said rotation phase detector, to output the computed feedback control signal.

5. The apparatus according to claim 1, further comprising:

a cylinder discrimination signal output device that outputs cylinder discrimination signals of different numbers during each of said reference angle signal is output, under a condition such that rotations of said crankshaft twice form one cycle;

a counter that counts the generation frequency of said cylinder discrimination signals during each of said reference angle signal is output; and a cylinder discriminating section that discriminates a cylinder which is to be on a predetermined piston position at output timing of each of said reference angle signal, based on a counted value by said counter.

6. The apparatus according to claim 5, wherein said internal combustion engine comprises a first camshaft that drives an intake valve and a second camshaft that drives an exhaust valve;

said variable valve timing mechanism and said cam angle detector are disposed to said first camshaft; and said cylinder discrimination signal output device detects a rotational position of said second camshaft, to output said cylinder discrimination signals.

7. A cam phase detecting apparatus for an internal combustion engine provided with a variable valve timing mechanism which changes a rotation phase of a camshaft relative to a crankshaft to vary valve timing of an engine valve, comprising:

cam angle detecting means for outputting a cam angle signal indicating a rotational position of said camshaft;

crank angle detecting means for detecting a rotational position of said crankshaft to output a reference angle signal at each crank angle corresponding to a stroke phase difference between cylinders in said internal combustion engine;

measuring means for measuring a phase difference between said cam angle signal and said reference angle signal; and rotation phase detecting means for detecting the rotation phase of said camshaft based on the phase difference measured by said measuring means, wherein:

said cam angle detecting means is provided with detectable portions for being detected on a rotation member which is rotated in association with said camshaft, at equiangular intervals, by numbers which are an integer n ($n \geqq 2$) times a number of cylinders, each having the engine valve driven by said camshaft, and detects said detectable portions to output said cam angle signals, so that said cam angle signals, the number of which are the integer n ($n \geqq 2$), are output in each generating interval of said reference angle signals, said measuring means measures a phase difference between a generation timing of said reference angle signal and each generation timing of subsequently outputted cam angle signals, the number of which are the integer n ($n \geqq 2$), and said rotation phase detecting means detects the rotation phase several times in each generation interval of said reference angle signals, by detecting the rotation phase of said camshaft at every time said cam angle signal is generated, based on the phase difference of each output of said cam angle signals measured by said measuring means.

8. A cam phase detecting method for an internal combustion engine provided with a variable valve timing mechanism which changes a rotation phase of a camshaft relative to a crankshaft to vary valve timing of an engine valve, comprising the steps of:

outputting a cam angle signal indicating a rotational position of said camshaft;

detecting a rotational position of said crankshaft to output a reference angle signal at each crank angle corresponding to a stroke phase difference between cylinders in said internal combustion engine;

measuring a phase difference between said cam angle signal and said reference angle signal; and detecting the rotation phase of said camshaft based on the phase difference, wherein:

said step of outputting the cam angle signal outputs said cam angle signals of numbers which are an integer n ($n \geqq 2$) times a number of cylinders having the engine valves driven by said camshaft, respectively, to thereby output said cam angle signals, the number of which are the integer n (n≧2), in each generating interval of said reference angle signals, said step of measuring the phase difference between said cam angle signal and said reference angle signal measures a phase difference between a generation timing of said reference angle signal and each generation timing of subsequently outputted cam angle signals, the number of which are the integer n (n≧2), and said step of detecting the rotation phase of said camshaft detects the rotation phase several times in each generation interval of said reference angle signals, by detecting the rotation phase of said camshaft at every time said cam angle signal is generated, based on the phase difference of each output of said cam angle signals.

9. The method according to claim 8, wherein said step of outputting the cam angle signal changes output timing of each of said cam angle signal within an angular range defined between each of said reference angle signal, in response to a change in the rotation phase of said camshaft.

10. The method according to claim 8, wherein said step of outputting the cam angle signal outputs the cam angle signals of the numbers which are 2 times the number of cylinders having the engine valve driven by said camshaft, per one rotation of said camshaft.

11. The method according to claim 8, further comprising the step of executing a computation of a feedback control signal for said variable valve timing mechanism, based on said detected rotation phase of said camshaft.

12. The method according to claim 8, further comprising the steps of:

outputting cylinder discrimination signals of different numbers during outputting of each of said reference angle signal under such a condition that rotations of said crankshaft twice form one cycle;

counting generation frequency of said cylinder discrimination signals during outputting of each of said reference angle signal; and discriminating a cylinder which occupies a predetermined piston position at timing of outputting of each said reference angle signal, based on said counted value.

* * * * *